US008665280B2

(12) United States Patent
Lai et al.

(10) Patent No.: US 8,665,280 B2
(45) Date of Patent: Mar. 4, 2014

(54) CONTROLLING DISPLAY UPDATES FOR ELECTRO-OPTIC DISPLAYS

(75) Inventors: Jimmy Kwok Lap Lai, Vancouver (CA); Tetsuo Kawamoto, Nagano-ken (JP); Yun Shon Low, Richmond (CA)

(73) Assignee: Seiko Epson Corporation, Tokyo (JP)

( * ) Notice: Subject to any disclaimer, the term of this patent is extended or adjusted under 35 U.S.C. 154(b) by 620 days.

(21) Appl. No.: 12/907,220

(22) Filed: Oct. 19, 2010

(65) Prior Publication Data

US 2011/0285730 A1 Nov. 24, 2011

Related U.S. Application Data

(60) Provisional application No. 61/347,263, filed on May 21, 2010.

(51) Int. Cl.
*G09G 5/39* (2006.01)

(52) U.S. Cl.
USPC ..... 345/531; 345/589; 345/501; 345/506; 345/520; 345/522; 345/107; 707/697; 707/699; 707/5; 707/260; 707/267

(58) Field of Classification Search
None
See application file for complete search history.

(56) References Cited

U.S. PATENT DOCUMENTS

| | | | |
|---|---|---|---|
| 2006/0017659 | A1 | 1/2006 | Ogawa et al. |
| 2006/0209055 | A1 | 9/2006 | Wakita |
| 2007/0013649 | A1 | 1/2007 | Kim et al. |
| 2009/0096744 | A1 | 4/2009 | Kim et al. |

FOREIGN PATENT DOCUMENTS

| | | |
|---|---|---|
| JP | 2007-293400 | 11/2007 |
| WO | 2005/022501 A1 | 3/2005 |

*Primary Examiner* — Antonio A Caschera

(57) ABSTRACT

A display controller may include a display update controller that may cause a color processing operation to be initiated in response to completion of an image data transmission, or a display update operation to be initiated in response to completion of the color processing operation. The display update operation may include updating display pixels of a display matrix of an electro-optic display device. A collision detector may determine whether a waveform for updating a display state of a particular display pixel has finished. The display update controller may cause the particular display pixel to be omitted from a display update operation if the waveform for updating the display state of the particular display pixel has not finished. A second display update operation may automatically be initiated when the waveform for updating the display state of the particular display pixel has finished.

12 Claims, 10 Drawing Sheets

CONTROLLING DISPLAY UPDATES FOR ELECTRO-OPTIC DISPLAYS

CROSS REFERENCE TO RELATED APPLICATIONS

The present application claims the benefit under 35 USC Section 119(e) of U.S. Provisional Patent Application Ser. No. 61/347,263, filed May 21, 2010. The present application is based on and claims priority from this provisional application, the disclosure of which is hereby expressly incorporated herein by reference in its entirety.

FIELD

This application relates generally to driving or updating active-matrix, electro-optic display devices with display pixels having multiple stable display states.

BACKGROUND

An electro-optic material has at least two "display states," the states differing in at least one optical property. An electro-optic material may be changed from one state to another by applying an electric field across the material. The optical property may or may not be perceptible to the human eye, and may include optical transmission, reflectance, or luminescence. For example, the optical property may be a perceptible color or shade of gray.

Electro-optic displays include the rotating bichromal member, electrochromic medium, electro-wetting, and particle-based electrophoretic types. Electrophoretic display devices ("EPD"), sometimes referred to as "electronic paper" devices, may employ one of several different types of electro-optic technologies. Particle-based electrophoretic media include a fluid, which may be either a liquid, or a gaseous fluid. Various types of particle-based EPD devices include those using encapsulated electrophoretic, polymer-dispersed electrophoretic, and microcellular media. Another electro-optic display type similar to EPDs is the dielectrophoretic display.

An electro-optic display device may have display pixels or sub-pixels that have multiple stable display states. Display devices in this category are capable of displaying (a) two or more display states, and (b) the display states are considered stable. The display pixels or sub-pixels of a bistable display may have first and second stable display states. The first and second display states differ in at least one optical property, such as a perceptible color or shade of gray. For example, in the first display state, the display pixel may appear black and in the second display state, the display pixel may appear white. The display pixels or sub-pixels of a display device having multiple stable display states may have three or more stable display states, each of the display states differing in at least one optical property, e.g., light, medium, and dark shades of a particular color. For example, the display pixels or sub-pixels may display states corresponding with 4, 8, 16, 32, or 64 different shades of gray.

With respect to capability (b), the display states may be considered to be stable, according to one definition, if the persistence of the display state with respect to display pixel drive time is sufficiently large. An exemplary electro-optic display pixel or sub-pixel may include a layer of electro-optic material situated between a common electrode and a pixel electrode. The display state of the display pixel or sub-pixel may be changed by driving a drive pulse (typically a voltage pulse) on one of the electrodes until the desired appearance is obtained. Alternatively, the display state of a display pixel or sub-pixel may be changed by driving a series of pulses on the electrode. In either case, the display pixel or sub-pixel exhibits a new display state at the conclusion of the drive time. If the new display state persists for at least several times the duration of the drive time, the new display state may be considered stable. Generally, in the art, the display states of display pixels of liquid crystal displays ("LCD") and CRTs are not considered to be stable, whereas electrophoretic displays, for example, are considered stable.

As compared with an LCD or CRT, a longer time may be required to update an image on an electro-optic display. Accordingly, any reduction in image update time would be desirable. In addition, management of the update process for an electro-optic display may require more host activity than is required with an LCD. Moreover, as electro-optic displays with refresh times faster than past display devices become available, video rendering on an electro-optic displays may become feasible, which will further increase the display update management burden on a host. A host may need to handle more frames in the same time period. Furthermore, color electro-optic displays may become commercially available and management of the update process for color electro-optic displays may require more host activity than that required for gray-scale displays. Accordingly, the capability to update an electro-optic display with minimal host involvement would be desirable.

SUMMARY OF DISCLOSURE

An embodiment is directed to method. The method may include receiving a transmission of image data by an image data receiver, and initiating a color processing operation on the image data. The image data receiver may initiate the color processing operation independently without the need for an image data transmitter to send a command to initiate the color processing. When the image data receiver is configured to automatically initiate the color processing operation in response to completion of the transmission of image data, the image data receiver may initiate the color processing operation in response to completion of the transmission of image data. The method may include updating display pixels of a display matrix of an electro-optic display device. The image data receiver may be configured to automatically initiate the color processing operation in response to completion of the transmission of image data.

The method may further include initiating a display update operation. The image data receiver may initiate the display update operation in response to completion of the color processing operation when not configured to automatically initiate the color processing operation in response to completion of the transmission of image data, or when configured to automatically initiate the color processing operation in response to completion of the transmission of image data. In one embodiment, the display device may be an electrophoretic display device.

The display update operation may include: fetching a data pixel corresponding with a particular display pixel from a first buffer, fetching a first synthesized pixel corresponding with the particular display pixel from a second buffer, and determining if a waveform for updating the display state of the particular display pixel has finished. If the waveform for updating the display state of the particular display pixel has not finished, the method may include omitting the particular display pixel from the display update operation. In addition, the method may include determining that the waveform for updating the display state of the particular display pixel has finished. This determination may be made subsequent to initiating the omission of the particular display pixel from the display update operation. A second display update operation may be initiated in response to determining that the waveform for updating the display state of the particular display pixel has finished. In one embodiment, the display device may be an electrophoretic display device.

In one embodiment, the receiving of a transmission of image data by the image data receiver may include determining a first checksum for the image data. The image data receiver may receive a transmission of second image data. The receiving of the transmission of second image data may include determining a second checksum for the second image data. If the first and second checksums are equal, an initiation of the color processing operation on the second image data in response to completion of the transmission of second image data may be disabled.

An embodiment is directed to a display controller. The display controller may include an interface to receive a transmission of image data, a color engine, a display update controller, and a display engine. The display update controller may cause the color engine to initiate a color processing operation on the image data in response to completion of the transmission of image data when the display controller is configured to automatically initiate the color processing operation in response to completion of the transmission of image data. The display engine may perform a display update operation. The display update operation may include updating display pixels of a display matrix of an electro-optic display device. The display controller may be configured to automatically initiate the color processing operation in response to completion of the transmission of image data. In one embodiment, the display controller may cause the display engine to initiate a display update operation in response to completion of the color processing operation. In an alternative embodiment, the display controller is not configured to automatically initiate the color processing operation in response to completion of the transmission of image data, and the display update controller may cause the display engine to initiate a display update operation in response to completion of the color processing operation. In one embodiment, the display device may be an electrophoretic display device.

In one embodiment, the display controller may include a collision detector to determine whether a waveform for updating a display state of a particular display pixel has finished. The display update controller may cause the particular display pixel to be omitted from a display update operation if the waveform for updating the display state of the particular display pixel has not finished. The display update controller may cause a second display update operation to be initiated in response to a determination by the collision detector that the waveform for updating the display state of the particular display pixel has finished. The determination by the collision detector that the waveform for updating the display state of the particular display pixel has finished may be made subsequent to the causing of the particular display pixel to be omitted from the display update operation. In one embodiment, the display device may be an electrophoretic display device.

In one embodiment, the display controller may include a unit to determine a first checksum for the image data and a second checksum for second image data. The display update controller may not cause the color engine to initiate a color processing operation on the second image data in response to completion of the transmission of second image data when the display controller is configured to automatically initiate the color processing operation in response to completion of the transmission of image data if the first and second checksums are equal.

DETAILED DESCRIPTION

Figure 1:
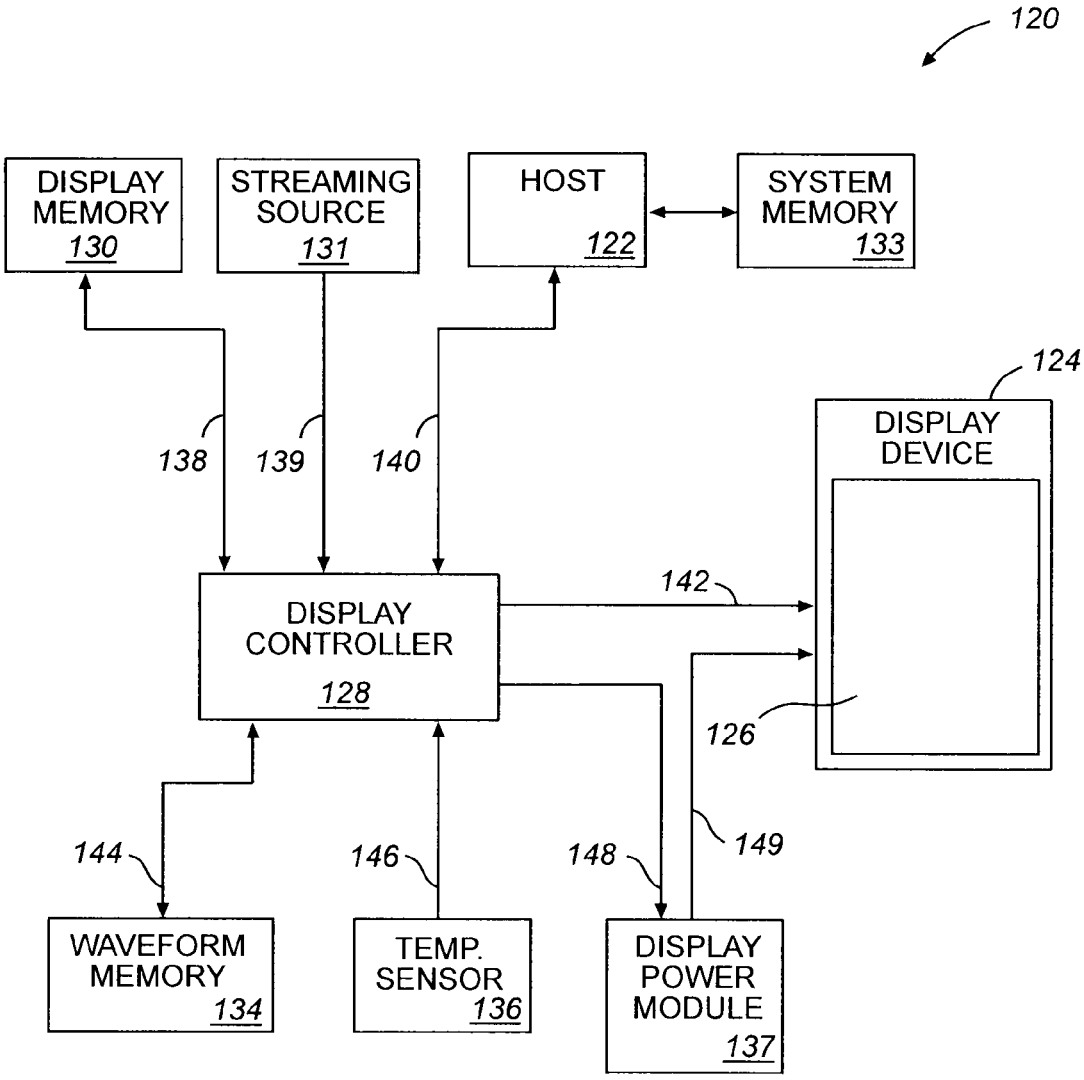
FIG. 1 is a simplified block diagram of an exemplary display system in which embodiments may be implemented.

This detailed description and the drawings illustrate exemplary embodiments. In the drawings, like referenced-numerals may identify like units, components, operations, or elements. In addition to the embodiments specifically described, other embodiments may be implemented and changes may be made to the described embodiments without departing from the spirit or scope of the subject matter presented herein. This detailed description and drawings are not to be taken in a limiting sense; the scopes of the inventions described herein are defined by the claims.

FIG. 1 illustrates a block diagram of an exemplary display system 120 illustrating one context in which embodiments may be implemented. The system 120 may include a host 122, a display device 124 having a display matrix 126, a display controller 128, a display memory 130, a streaming input source 131, and a system memory 133. The system 120 may also include a waveform memory 134, a temperature sensor 136, and a display power module 137. In addition, the system 120 may include buses 138, 139, 140, 142, 144, 146, 148, and 149. The busses may be either serial or parallel buses. The system 120 may be any digital system or appliance. For example, the system 120 may be a battery-powered portable appliance, such as an electronic reader, cellular telephone, digital photo frame, or display sign. FIG. 1 shows only those aspects of the system 120 believed to be helpful for understanding the disclosed embodiments, numerous other aspects having been omitted.

The host 122 may be a general purpose microprocessor, digital signal processor, controller, computer, or any other type of device, circuit, or logic that executes instructions of any computer-readable type to perform operations. Any type of device that can function as a host or master is contemplated as being within the scope of the embodiments. The host 122 may be a "system-on-a-chip," having functional units for performing functions other than traditional host or processor functions. For example, the host 122 may include a transceiver or a display controller.

The system memory 133 may be may be an SRAM, VRAM, SGRAM, DDRDRAM, SDRAM, DRAM, flash, hard disk, or any other suitable volatile or non-volatile memory. The system memory may store instructions that the host 122 may read and execute to perform operations. The system memory may also store data.

The streaming input source 131 may be any source of image data for a display device. For example, the streaming input source 131 may provide still or video image data from a digital television, digital video camera, or a receiver.

The display device 124 may have display pixels that may be arranged in rows and columns forming a matrix ("display matrix") 126. A display pixel may be a single element or may include two or more sub-pixels. The display device 124 may be an electro-optic display device with display pixels having multiple stable display states in which individual display pixels may be driven from a current display state to a new display state by series of two or more drive pulses. In one alternative, the display device 124 may be an electro-optic display device with display pixels having multiple stable display states in which individual display pixels may be driven from a current display state to a new display state by a single drive pulse. The display device 124 may be an active-matrix display device. In one embodiment, the display device 124 may be an active-matrix, particle-based electrophoretic display device having display pixels that include one or more types of electrically-charged particles suspended in a fluid, the optical appearance of the display pixels being changeable by applying an electric field across the display pixel causing particle movement through the fluid. The display device 124 may be coupled with the display controller 128 via one or more buses 142, 149 that the display controller uses to provide pixel data and control signals to the display. The display device 124 may be a gray-scale display or a color display. In one embodiment, the display controller 128 may receive as input and provide as output either gray-scale or color images.

The display state of a display pixel is defined by one or more bits of data, which may be referred to as a "data pixel." An image is defined by data pixels and may be referred to as a "frame."

In one embodiment, the display controller 128 may be disposed on an integrated circuit ("IC") separate from other elements of the system 120. In an alternative embodiment, the display controller 128 need not be embodied on a separate IC. In one embodiment, the display controller 128 may be integrated into one or more other elements of the system 120. For example, the display controller 128 may integrated with the host 122 on a singe IC.

The display memory 130 may be internal or external to the display controller 128, or may be divided with one or more components internal to the display controller, and one or more components external to the display controller. The display memory 130 may be an SRAM, VRAM, SGRAM, DDRDRAM, SDRAM, DRAM, flash, hard disk, or any other suitable volatile or non-volatile memory. The display memory 130 may store data or instructions.

The waveform memory 134 may be a flash memory, EPROM, EEPROM, or any other suitable non-volatile memory. The waveform memory 134 may store one or more different drive schemes, each drive scheme including one or more waveforms used for driving a display pixel to a new display state. The waveform memory 134 may include a different set of waveforms for one or more update modes. The waveform memory 134 may include waveforms suitable for use at one or more temperatures. The waveform memory 134 may be coupled with the display controller 128 via a serial or parallel bus. In one embodiment, the waveform memory 134 may store data or instructions.

The temperature sensor 136 may be provided to determine ambient temperature. The drive pulse (or more typically, the series of drive pulses) required to change the display state of a display pixel to a new display state may depend, in part, on temperature. The temperature sensor 136 may be mounted in any location suitable for obtaining temperature measurements that approximate the actual temperatures of the display pixels of the display device 124. The temperature sensor 136 may be coupled with the display controller 128 in order to provide temperature data that may be used in selecting a drive scheme.

The power module 137 may be coupled with the display controller 128 and the display device 124. The power module 137 may receive signals from the display controller 128 and generate appropriate voltages (or currents) to drive selected display pixels of the display device 124. In one embodiment, the power module 137 may generate voltages of +15V, −15V, or 0V.

Figure 2:
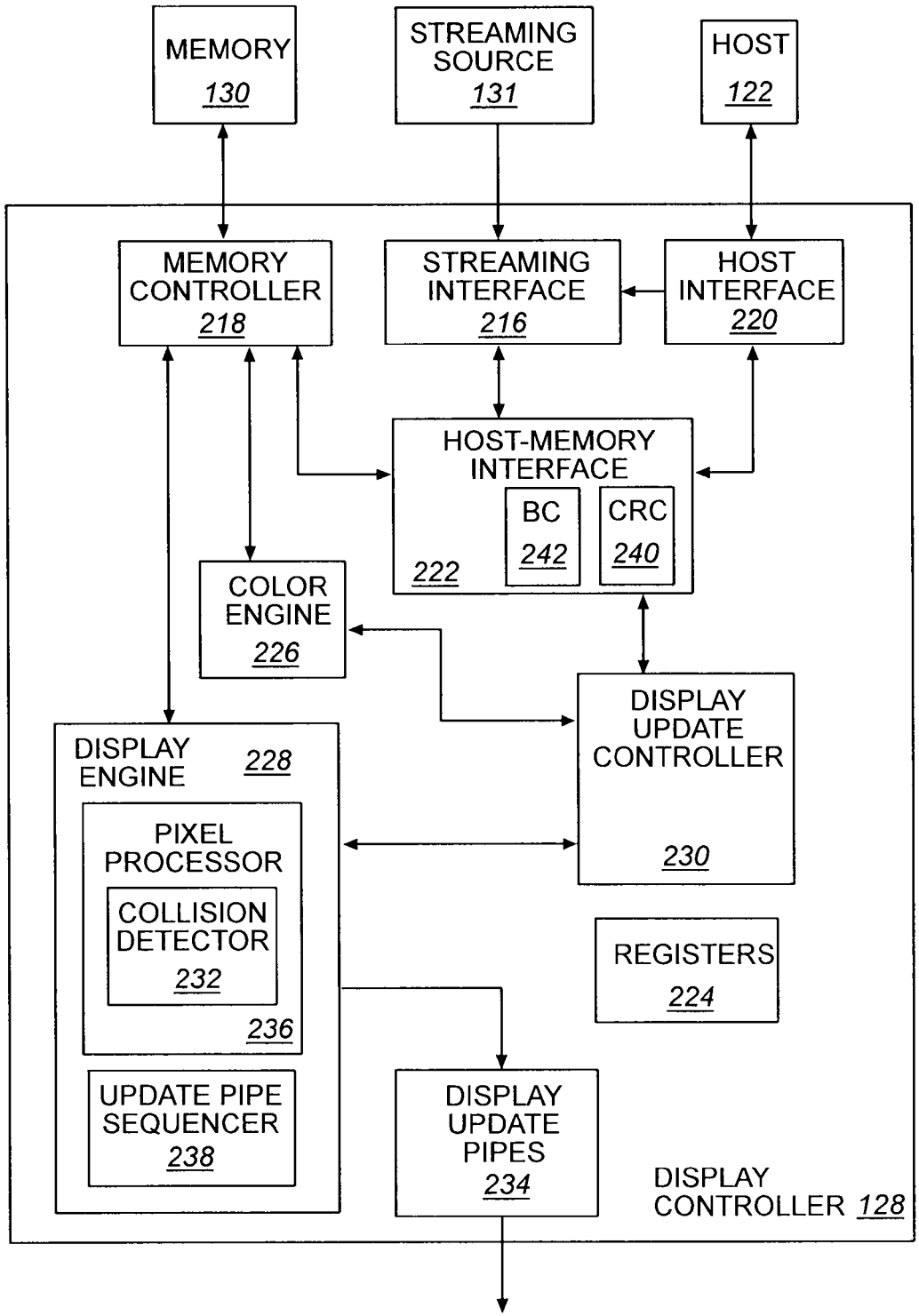
FIG. 2 is a simplified block diagram of a display controller according to one embodiment.

FIG. 2 illustrates the display controller 128 of FIG. 1 according to one embodiment. Image data may be transmitted to the display controller 128 from the streaming source 131 or host 122. The display controller 128 may include a streaming interface 216 and a host interface 220. The display controller 128 may use the memory 130 for storing image data when performing its operations. The streaming interface 216 and a host interface 220 may be employed for interfacing, respectively, with the streaming source 131 and host 122 during image data transfers. In addition, the host interface 220 may be employed for transferring control and status information between the host 122 and display controller 128. Further, the streaming interface 216 may receive control information, such as a start or end of data transfer signal.

The display controller 128 may include a memory controller 218. The memory controller 218 may be employed for interfacing with the memory 130 during image data transfers.

A host-memory interface 222 may obtain data and signals from the interfaces 216, 218, and 220. In one embodiment, the host-memory interface 222 includes a cyclic redundancy check (CRC) unit 240 and a buffer control (BC) unit 242.

The display controller 128 may include a color engine 226. The color engine 226 may be coupled with the memory controller 218 and a display update controller 230. The color engine 226 may include an operability to implement a color processing algorithm for a particular type of display device. The color engine 226 may format image data for user-defined color filter array (CFA). In one embodiment, the color engine 226 may include a Color Synthesis of Primaries unit, a White Sub-Pixel Generation unit, and a CFA Mapping and Post-Processing Unit as described in co-pending patent applications: U.S. patent application Ser. No. 12/907,178, entitled "Processing Color Sub-Pixels"; U.S. patent application Ser. No. 12/907,189, entitled "Arranging and Processing Color Sub-Pixels"; and U.S. patent application Ser. No. 12/907,208, entitled "Enhancing Color Images." The content of these co-pending applications are hereby incorporated by reference in their entirety. The Color Synthesis of Primaries unit may include a color correction unit, a color linearization unit (sometimes referred to as gamma correction), a luma scaling unit, a filtering unit, a color saturation adjustment unit, and a dithering unit. An input image received from an input source may be stored in the display memory 130 via the host-memory interface 222 and memory controller 218. If the input image to be rendered on the display device 124 is a color image, the input image may be processed by the color engine 226. After color processing by the color engine 226, the processed image data may be stored back in the memory 130.

The display controller 128 may include a display engine 228. The display engine 228 may be coupled with the memory controller 218 and the display update controller 230. The display engine 228 may include a pixel processor 236 and an update pipe sequencer 238. The pixel processor 236 may include a collision detector 232. The display engine 228 may be operable to perform a display update operation. A display update operation may include: (a) a pixel synthesis operation; and (b) a display output operation. A display update operation may be performed with respect to all of the display pixels of the display matrix 126 (an "entire" display update). Alternatively, a display update operation may be performed with respect to less than all of the display pixels of the display matrix 126 (a "regional" display update). In addition, two or more regional display updates may be performed in parallel. For example, a regional display update of a first region of the display matrix 126 may operate in parallel with a regional display update of a second region, provided the first and second regions do not include any of the same display pixels or sub-pixels. Another aspect of display update operations is that they may be either full or partial. A full display update drives all display pixels within a specified area (i.e., the entire display matrix or a region of the display) regardless of whether a new data pixel differs from the current data pixel for a particular display pixel. A partial display update, on the other hand, drives only those display pixels within the specified area for which the new data pixel differs from the current data pixel for a particular display pixel.

The display update pipe unit 234 of the display controller 128 may include one or more display update pipes. In one embodiment, the display update pipe 234 unit includes 16 update pipes. In one embodiment, each update pipe may be associated with a predetermined sub-area or region of the display matrix 126. However, this is not critical; in an alternative embodiment, an update pipe may be assigned to different regions at different times. A display update pipe becomes active during a display output operation. In the case of two or more simultaneous display output operations, a corresponding number of update pipes are active. During a display output operation, an active update pipe fetches synthesized pixel data for its associated or assigned region from the memory 130 and generates waveform data. The waveform data generated by active update pipes may be provided to the display power module 137 and the display device 124 in raster order.

In one embodiment, the display controller 128 may include the display update controller 230. The display update controller 230 may detect specified events. For example, the display update controller 230 may detect the end of a transfer of input image data to the display controller, the end of a color processing operation, or the end of a pixel synthesis operation. In response to a detection of an event, the display update controller 230 may cause the color engine 226 or display engine 228 or both to perform an operation, be triggered, or invoked.

The display controller 128 may include registers 224 (comprising multiple individual registers), which may be used to configure the display controller 128 for a particular mode of operations, to record status information, and to achieve other functions. The host 122 may configure the display controller 128 for a desired mode of operation by storing one or more parameters in the registers 224. In addition, the host 122 may configure the display controller 128 to detect for collisions, to perform a cyclic redundancy check (CRC) on successive frames by storing one or more parameters in the registers 224. The host 122 may control other aspects of operation or determine the status of aspects of an operation by reading or writing to the registers 224.

An exemplary electro-optic display pixel or sub-pixel includes a layer of electro-optic material situated between a common electrode and a pixel electrode. One of the electrodes, typically the common electrode, may be transparent. The common and pixel electrodes together form a parallel plate capacitor at each display pixel, and when a potential difference exists between the electrodes, the electro-optic material situated in between the electrodes experiences the resulting electric field.

An active-matrix display includes at least one non-linear circuit element, such as a transistor, for each display pixel or sub-pixel. The circuit element may be a thin-film transistor (TFT) having its drain terminal coupled with the pixel electrode. The gate and source terminals of the transistor are respectively coupled with a row select line and a column data line. To change the display state of the display pixel, the common electrode is placed at ground or some other suitable voltage and a row driver circuit turns on the transistor by driving a suitable voltage on the row select line. An optical-property-dependent voltage corresponding with a display state transition may then be driven on the column data line by a column driver circuit.

While the display state of a display pixel or sub-pixel may be changed by having the column driver apply and hold an appropriate drive pulse on a column data line until the desired display state is obtained in a single time interval, alternative methods may be employed for changing a display state. Various alternative methods provide for driving a series of drive pulses over time. In these methods, the display pixels or sub-pixels are refreshed or updated in a series of two or more "drive frames." For each drive frame in the series, each row is selected once, allowing the column driver to drive a drive pulse onto each display pixel or sub-pixel of the selected row having its display state changed. The duration of time that each row is selected may be identical so that each drive frame in the series is of identical duration. Thus, instead of changing the display state of a display pixel or sub-pixel with a single drive pulse in a single time period, the display state may be changed by driving a series of drive pulses in a series of time periods regularly spaced in time.

Figure 3:
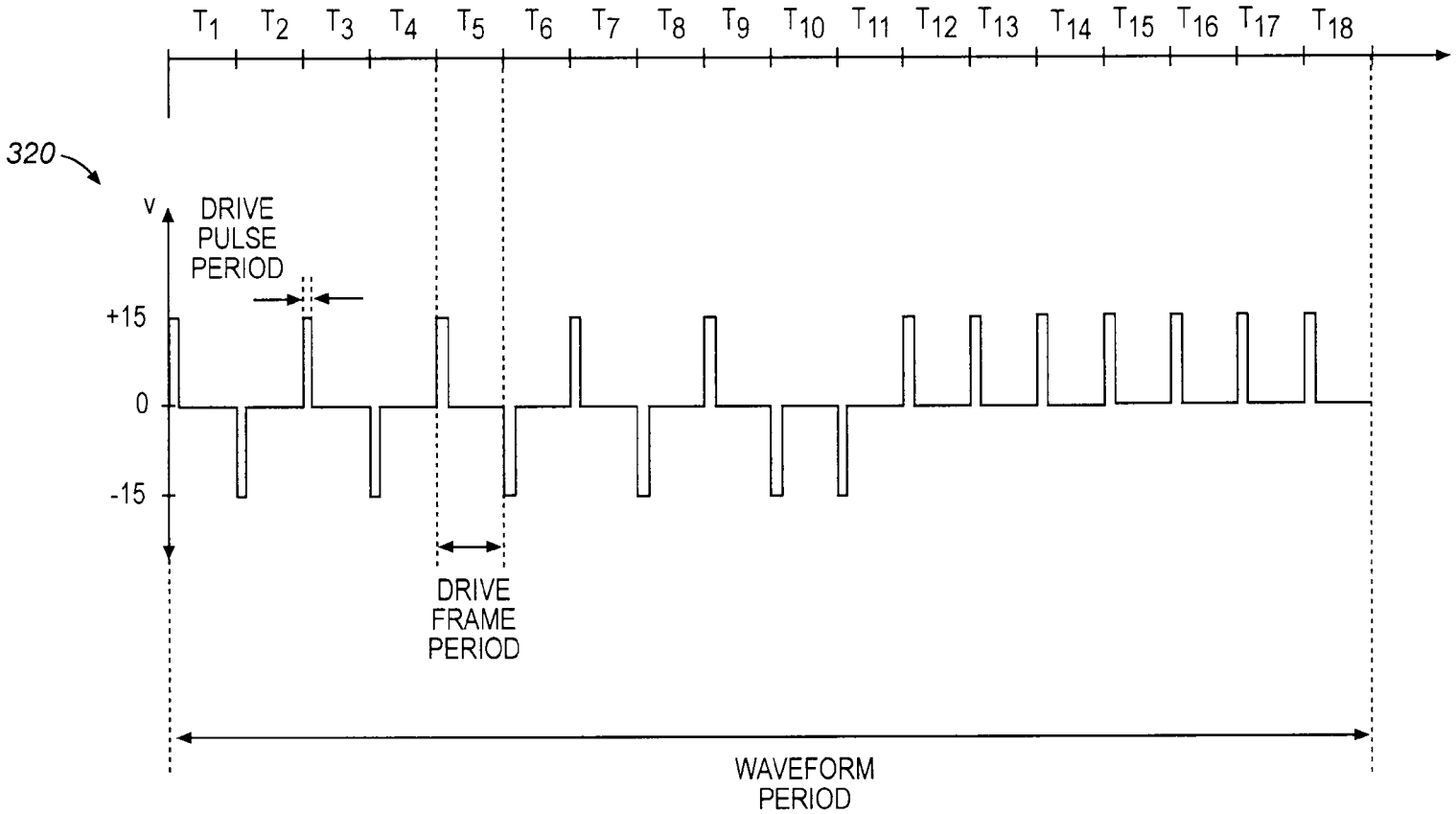
FIG. 3 illustrates an exemplary waveform having a waveform period, and a plurality of drive pulses and drive frame periods.

FIG. 3 shows an exemplary waveform 320. The term "waveform" may be used in this description to denote the entire series of drive pulses occurring in a series of time periods regularly spaced in time that are used to cause a transition from some initial display state to a final display state. A waveform may include one or more "pulses" or "drive pulses," where a pulse or a drive pulse generally refers to the integral of voltage with respect to time, but may refer to the integral of current with respect to time. The term "drive scheme" may be used in this description to refer to a set of waveforms sufficient to effect all possible transitions between display states for a specific display device under particular environmental conditions.

In one embodiment, a "synthesized pixel" is a data structure or a data record that defines a pixel transition. A synthesized pixel may include data defining a current display state and a next display state. A synthesized pixel may additionally include an identifier of an assigned update pipe within the update pipe unit 234. The update pipe uses the current and next display states of a synthesized pixel to locate drive pulse data in the lookup table and stores the pulse data in a first-in-first-out memory ("FIFO") memory, which may be included within the update pipe.

The waveform 320 is provided for the purpose of illustrating features of waveforms generally and for defining terms. The time period in which a single drive pulse is driven may be referred to as the "drive pulse period." In one embodiment, the drive pulse periods are of identical duration. The time period in which all of the lines of a display matrix 126 are addressed once may be referred to as the "drive frame period." In one embodiment, each drive frame period is of identical duration. The time associated with the entire series of drive frame periods may be referred to as the "waveform period." The "drive time" of a display pixel or sub-pixel may be equal to a waveform period.

The display device 124 may make use of multiple drive schemes. For example, the display device 124 may use a gray scale drive scheme, which can be used to cause transitions between all possible gray levels. In addition, display device 124 may use a monochrome drive scheme, which can be used to cause transitions only between two gray levels, e.g., black or white. Further, the display device 124 may use a pen update drive scheme, which can be used to cause transitions having an initial state that includes all possible gray levels and a final state of either black or white. A drive scheme may be selected based on the type of display state transitions that are needed. Various drive schemes may be employed with either gray-scale or color displays. Different drive schemes may have different waveform periods.

The update pipes within the update pipe unit 234 generate waveforms for their respective regions independently. For example, a regional display update of a first region may operate in parallel with a regional display update of a second region, provided the first and second regions do not include any of the same display pixels or sub-pixels. Each display update operation may use a different drive scheme, and the display update operations may overlap in time. One regional update may be a full display update while the other regional update is a partial display update. The updating of a first region of the display matrix using a first drive scheme can begin even while a display update operation for updating a second region using a drive scheme is in progress.

Figure 4:
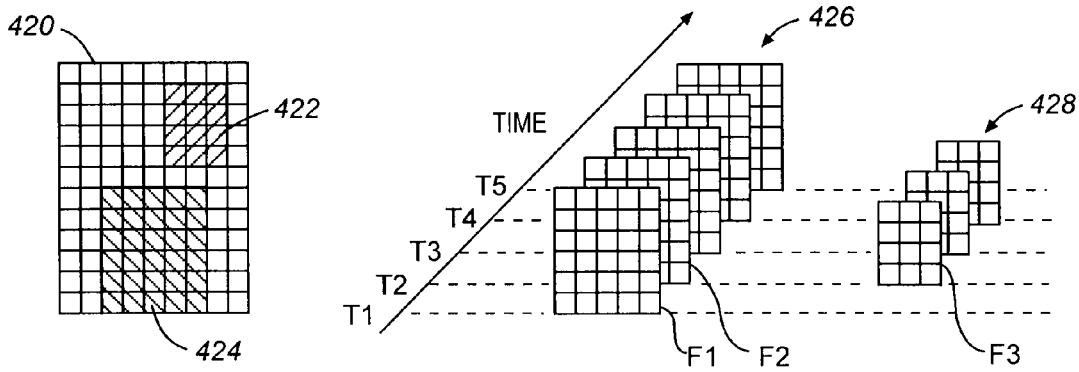
FIG. 4 illustrates an exemplary display matrix having first and second regions, the regions having differing waveform periods.

Referring to FIG. 4, a display matrix 420 having regions 422 and 424, and frame sequences 426, 428 for respectively updating the regions 424 and 422 are shown. Assume that the regions 422 and 424 are to be updated using different drive schemes and that the update periods for the two drive schemes are different: the update period for the region 424 is five drive frames, while the update period for the region 422 is three drive frames. In drive frame period T1, the first pulses (represented by frame F1) of the respective waveforms for the pixels of region 424 are provided by a first update pipe. In drive frame period T2, the second pulses (represented by frame F2) of the respective waveforms for the pixels of region 424 are provided by the first update pipe. Additionally, in drive frame period T2, the first pulses (represented by frame F3) of the respective waveforms for the pixels of region 422 are provided by a second update pipe.

Figure 5:
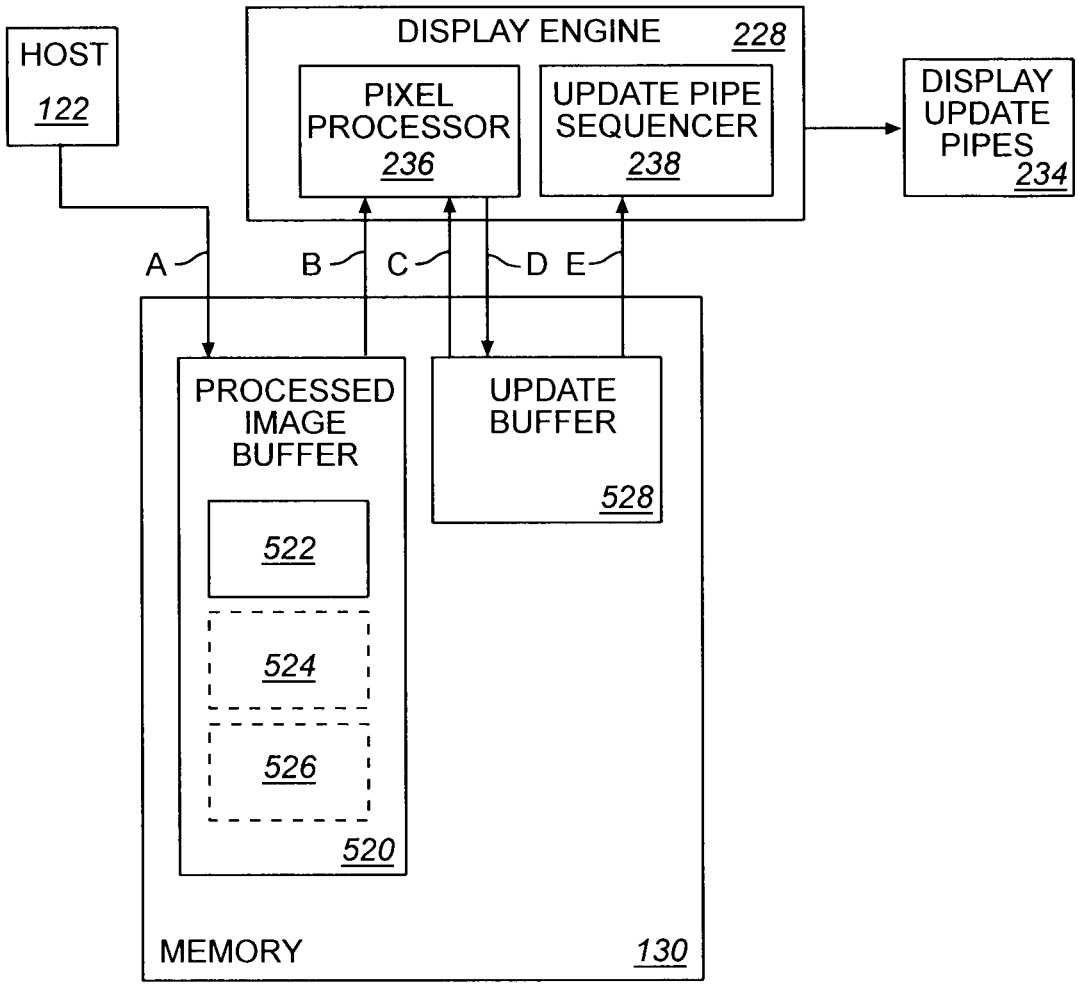
FIG. 5 is a simplified block diagram of a memory for use with an exemplary display controller and a gray-scale display device according to one embodiment.

FIG. 5 is a simplified block diagram of a memory for use with an exemplary display controller configured for gray-scale operation and a gray-scale display device according to one embodiment. FIG. 5 illustrates exemplary data paths between the display memory 130 and the host 122, pixel processor 236, and update pipe sequencer 238, according to one embodiment. The display memory 130 may include a processed image buffer 520 and an update buffer 528. The processed image buffer 520 may include one or more buffers. For example, the processed image buffer 520 may include first processed image buffer 522. Alternatively, the processed image buffer 520 may include first processed image buffer 522 and second processed image buffer 524. In yet another alternative, the processed image buffer 520 may include first processed image buffer 522, second processed image buffer 524, and third processed image buffer 526. The first, second, and third processed image buffers 522, 524, and 526 may each store a frame of data pixels. The host 122, streaming image source 131 or other data source may store full or partial frames of image data in the display memory 130. The pixel processor 236 may access the display memory 130 in a pixel synthesis operation and the update pipe sequencer 238 may access the display memory 130 in a display update operation.

The host 122, streaming image source 131 or other data source may store full or partial frames of data pixels in the processed image buffer 520 using data path A. Data pixels may be stored while a pixel synthesis operation, a display output operation, or both are in progress.

The pixel processor 236 may generate synthesized pixels. The pixel processor 236 may read a data pixel stored in the processed image buffer 520 to obtain data defining a next display state of a display pixel using data path B. In addition, the pixel processor 236 may read a synthesized pixel stored in the update buffer 528 to obtain data defining a current display state of a display pixel using data path C. The pixel processor 236 may use the data pixel obtained from the image buffer 520 and a synthesized pixel obtained from the update buffer 528 to generate a new synthesized pixel. The pixel processor 236 may store synthesized pixels that it generates in the update buffer 528 using data path D. The storing of a synthesized pixel in the update buffer 528 by the pixel processor 236 may overwrite a previously stored synthesized pixel. The update pipe sequencer 238 may perform a display output operation. In a display output operation, the update pipe sequencer 238 may fetch synthesized pixels from the update buffer 528 using data path E.

Figure 6:
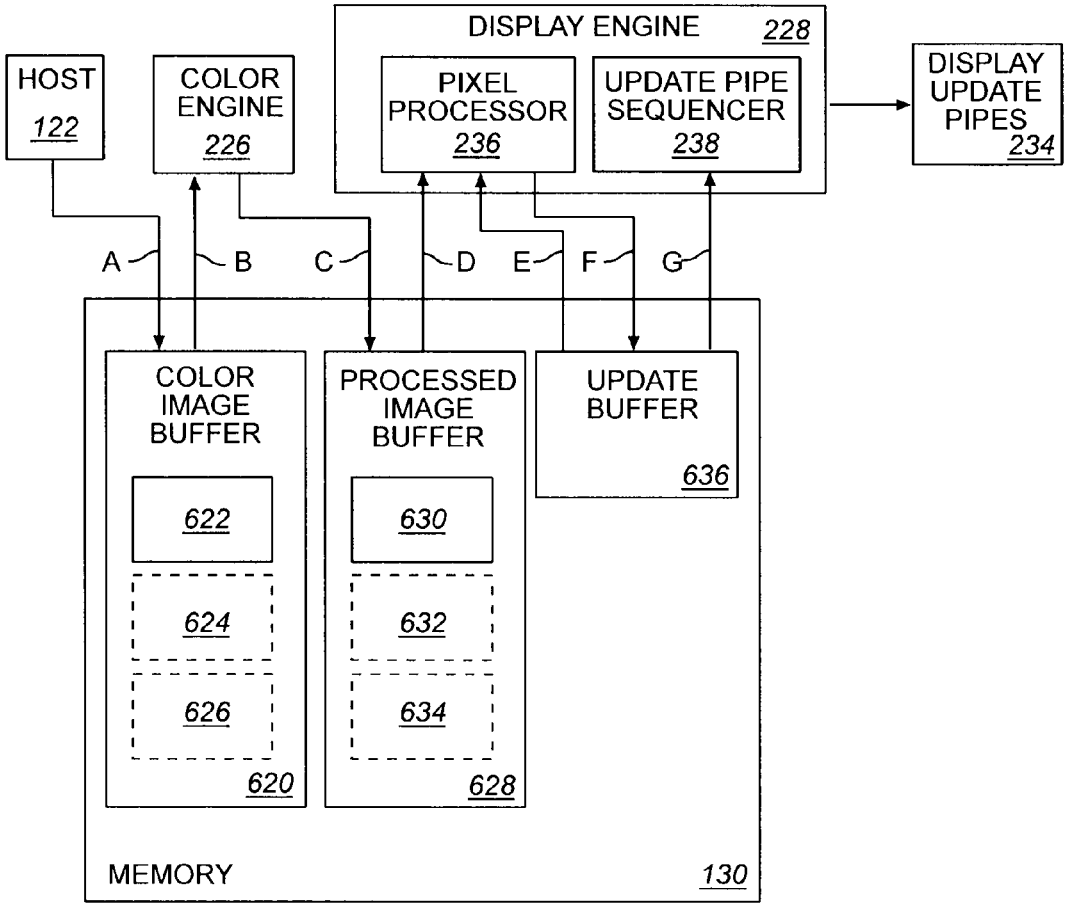
FIG. 6 is a simplified block diagram of a memory for use with an exemplary display controller and a color display device according to one embodiment.

FIG. 6 is a simplified block diagram of a memory for use with an exemplary display controller configured for color operation and a color display device according to one embodiment. FIG. 6 illustrates exemplary data paths between the display memory 130 and the host 122, pixel processor 236, and update pipe sequencer 238, according to one embodiment. The display memory 130 may include a color image buffer 620, a processed image buffer 628, and an update buffer 636.

The color image buffer 620 may include one or more buffers. For example, the color image buffer 620 may include first color image buffer 622. Alternatively, the color image buffer 620 may include first color image buffer 622 and second color image buffer 624. In yet another alternative, the color image buffer 620 may include first color image buffer 622, second color image buffer 624, and third color image buffer 626. The first, second, and third color image buffers 622, 624, and 626 may each store a frame of data pixels.

The processed image buffer 628 may include one or more buffers. For example, the processed image buffer 628 may include first processed image buffer 630. Alternatively, the processed image buffer 628 may include first processed image buffer 630 and second processed image buffer 632. In yet another alternative, the processed image buffer 628 may include first processed image buffer 630, second processed image buffer 632, and third processed image buffer 634. The first, second, and third processed image buffers 630, 632, and 634 may each store a frame of data pixels.

The host 122, streaming image source 131 or other data source may store full or partial frames of image data in the display memory 130. The color engine 226 may access the display memory 130 in performance of a color operation. The pixel processor 236 may access the display memory 130 in performance of a pixel synthesis operation. The update pipe sequencer 238 may access the display memory 130 in performance of a display update operation.

The host 122, streaming image source 131, or other data source may store full or partial frames of data pixels in the color image buffer 620 using data path A. Data pixels may be stored while a pixel synthesis operation, a display output operation, or both are in progress.

The color engine 226 may process data pixels or sub-pixels. The color engine 226 may read a data pixel or sub-pixel stored in the color image buffer 620 using data path B. The color engine 226 may store pixels or sub-pixels after processing in the processed image buffer 628 using data path C.

The pixel processor 236 may generate synthesized pixels. The pixel processor 236 may read a data pixel stored in the processed image buffer 628 to obtain data defining a next display state of a display pixel using data path D. In addition, the pixel processor 236 may read a synthesized pixel stored in the update buffer 636 to obtain data defining a current display state of a display pixel using data path E. The pixel processor 236 may use the data pixel obtained from the color image buffer 620 and a synthesized pixel obtained from the update buffer 636 to generate a new synthesized pixel. The pixel processor 236 may store synthesized pixels that it generates in the update buffer 636 using data path F. The storing of a synthesized pixel in the update buffer 636 by the pixel processor 236 may overwrite a previously stored synthesized pixel.

The update pipe sequencer 238 may perform a display output operation. In the display output operation, the update pipe sequencer 238 may fetch synthesized pixels from the update buffer 636 using data path G.

Figure 7:
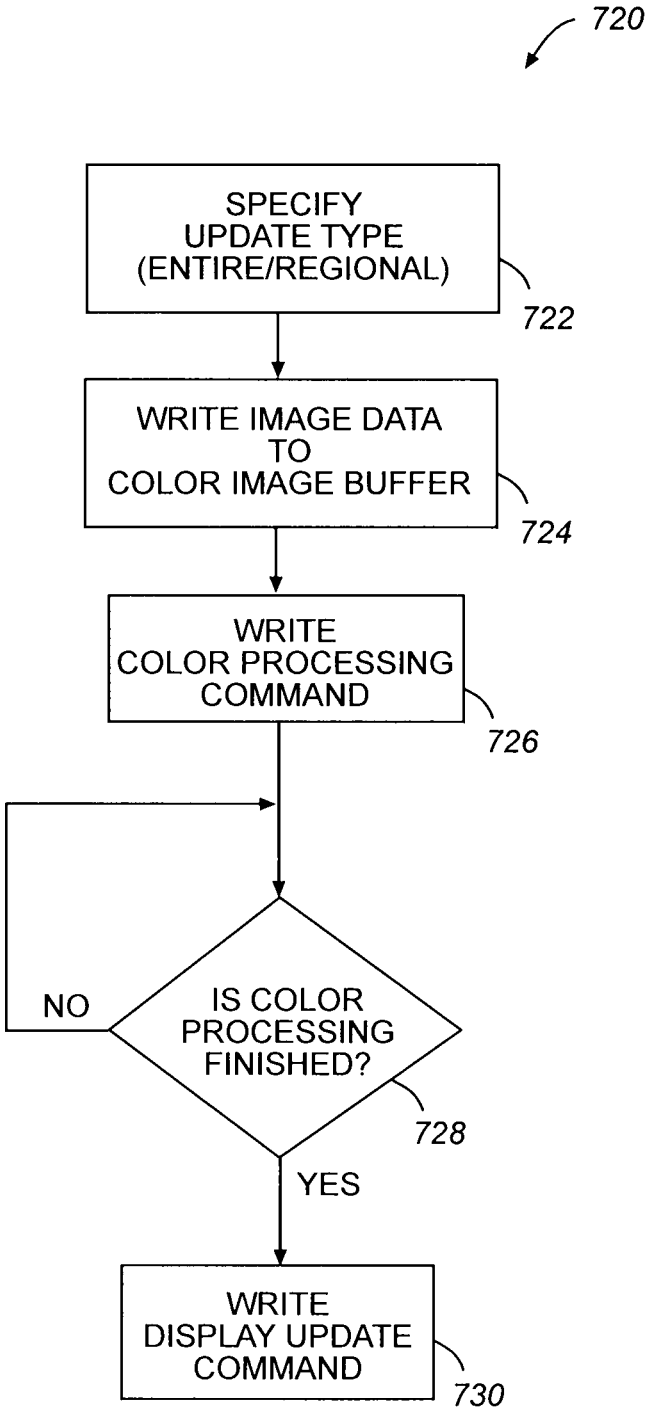
FIG. 7 is a simplified flow diagram illustrating a method for updating a display with color data using an exemplary display controller configured for manual control.

FIG. 7 is a simplified flow diagram illustrating a method 720 that may be performed by the host 122 to update the display matrix 126 with color pixel data. The method 720 may be used with an exemplary display controller configured for "manual" operation. In operation 722, the host 122 writes one or more commands to the display controller 128 specifying the region of the display matrix to be updated. In operation 724, the host 122 stores color pixel data in the color image buffer 620. The operation 724 may include the host 122 writing a command to the display controller 128 indicating that the storing of image data has finished. Alternatively, the streaming source 131 stores color pixel data in the color image buffer 620. In operation 726, the host 122 may issue a command to the display controller 128 instructing the color engine 226 to begin processing the image data stored in the color image buffer 620. In operation 728, the host 122 may poll a color process "busy" bit stored in one of the registers 224. By repeatedly polling the color process busy bit, the host 122 may learn when the color processor finishes processing the image data stored in the color image buffer 620. It is important to know when the color process finishes so that a display update can be triggered as soon as the color processing is done. In operation 730, the host 122 may issue a command to the display controller 128 instructing the display engine 228 to begin a display update.

In operation 722, and in operations 822, 922, and 1022 described below, the host 122 may specify a region of the display matrix to be updated. In these operations, the host 122 may specify either that the display update operation is to be performed with respect to all of the display pixels of the display matrix 126 (entire display update) or with respect to less than all of the display pixels of the display matrix 126 (regional display update). In the later case, the host 122 may also specify coordinates of the region(s). In addition, operation 722, and operations 822, 922, and 1022, may include the host 122 writing a command to the display controller 128 specifying a port of the display controller 128 that image data will be transferred to, i.e., host interface 220, streaming interface 216, etc.

In operation 730, and operation 928 described below, the host 122 may issue a command to the display controller 128 instructing the display engine 228 to begin a display update. The operations 730 and 928 may include specifying whether the entire display matrix 126 is to be updated or only one or more regions of the display matrix. In addition, the operations 730 and 928 may include specifying whether only those display pixels having new pixel data will be updated (partial update), or whether all display pixels will be updated regardless of whether they have new pixel data (full update).

A disadvantage of the method 720 is that the host 122 must perform a relatively large number of commands. This disadvantage is exacerbated when there are a large number of image updates to be performed. A particular disadvantage is the host 122 must repeatedly poll the display controller 128 to learn when color processing finishes. If the host 122 is performing other priority activities and delays its polling of the display controller 128, there may be a lag between when color processing finishes and a display update begins. This undesirably slows the refreshing of the display matrix 126.

Figure 8:
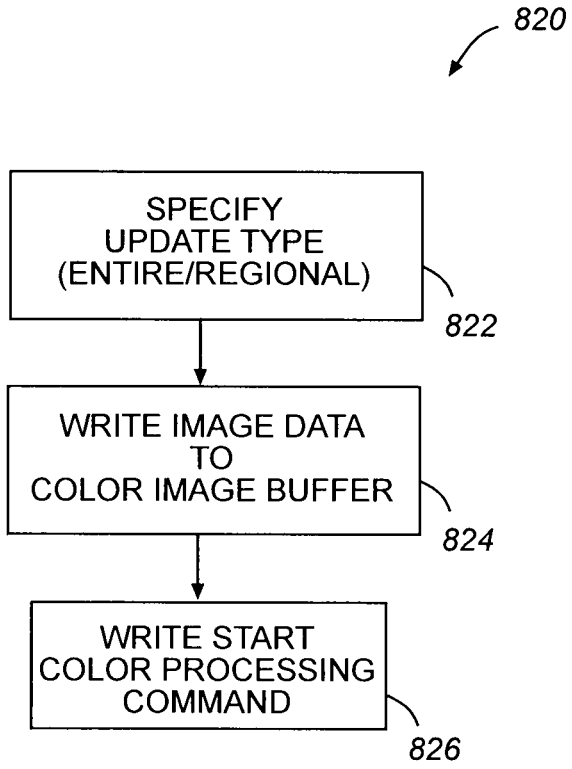
FIG. 8 is a simplified flow diagram illustrating a method for updating a display with color data using an exemplary display controller configured for automatically triggering a display engine when a color processing operation finishes.

FIG. 8 is a simplified flow diagram illustrating a method 820 that may be performed by the host 122 to update the display matrix 126 with color pixel data, according to one embodiment. The method 820 may be used with an exemplary display controller configured so that operation of the display engine 228 may be automatically invoked when the color engine 226 completes its operations. In operation 822, the host 122 writes one or more commands to the display controller 128 specifying the region of the display matrix to be updated. In operation 824, the host 122 stores color pixel data in the color image buffer 620. Alternatively, the streaming source 131 stores color pixel data in the color image buffer 620. In one embodiment, the operation 824 may include the host 122 writing a command to the display controller 128 indicating that the storing of image data has finished. In operation 826, the host 122 may issue a command to the display controller 128 instructing the color engine 226 to begin processing the image data stored in the color image buffer 620. When the color engine 226 finishes processing the stored image data, the display update controller 230 may issue a command instructing the display engine 228 to begin a display update operation.

The method 820 may provide several advantages. The host 122 need not repeatedly poll the color process "busy" bit. In addition, the host 122 need not issue a command to the display controller 128 instructing the display engine 228 to begin a display update. Another advantage of the method 820 is that it provides the host 122 with capability to write image data to the color image buffer 620 at different times and then process all of the color image data together. For instance, the host 122 may write first image data for a first region to the color image buffer 620 at a first time, and then at a subsequent time write second image data for a second region to the color image buffer 620. After storing of the second image data is complete, the host 122 may issue a command to begin processing the image data stored in the color image buffer 620, and the color engine 226 may process the first and second region in the same color processing operation. And after color processing is complete, a display update operation for the first and second regions will be automatically triggered.

Figure 9:
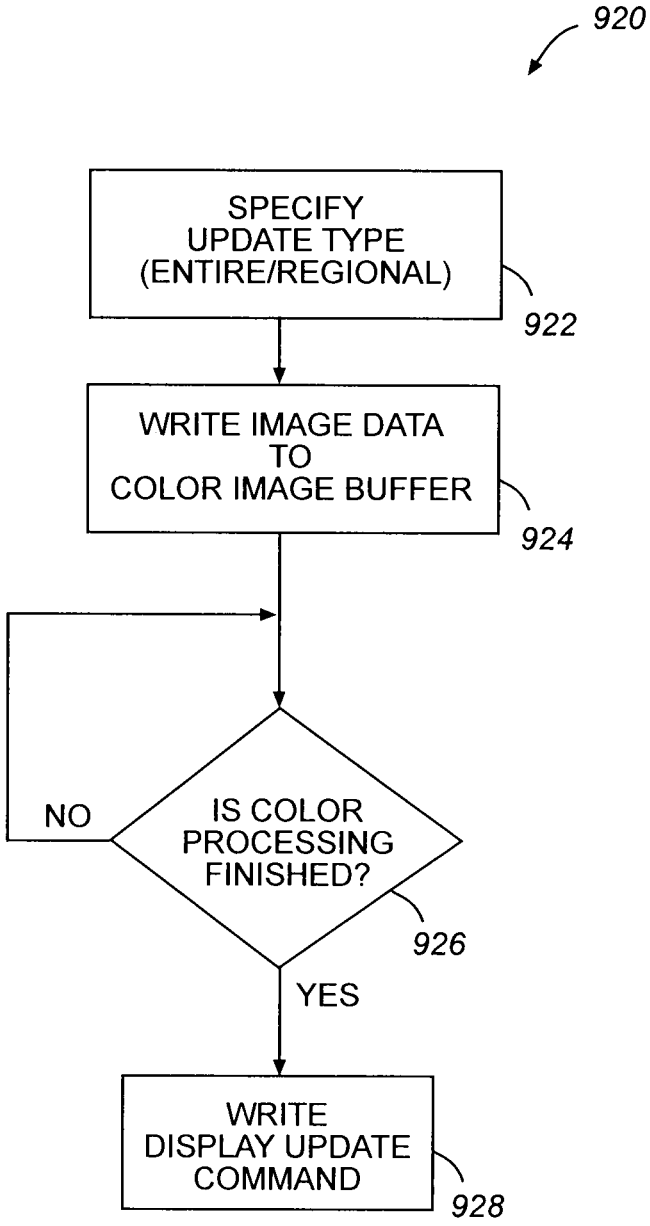
FIG. 9 is a simplified flow diagram illustrating a method for updating a display with color data using an exemplary display controller configured for automatically triggering a color engine when a data transfer operation finishes.

FIG. 9 is a simplified flow diagram illustrating a method 920 that may be performed by the host 122 to update the display matrix 126 with color pixel data, according to one embodiment. The method 920 may be used with an exemplary display controller configured so that operation of the color engine 226 may be automatically invoked when a transfer of image data is completed. In operation 922, the host 122 writes one or more commands to the display controller 128 specifying the region of the display matrix to be updated. In operation 924, the host 122 stores color pixel data in the color image buffer 620. Alternatively, the streaming source 131 stores color pixel data in the color image buffer 620. In one embodiment, the operation 924 may include the host 122 writing a command to the display controller 128 indicating that the storing of image data has finished. In an alternative embodiment, the streaming source 131 provides a signal indicating that the storing of image data has finished, e.g., VSYNC. When the storing of image data has finished, the display update controller 230 issues a command instructing the color engine 226 to begin processing the image data stored in the color image buffer 620. In operation 926, the host 122 may poll a color process "busy" bit stored in one of the registers 224. By repeatedly polling the color process busy bit, the host 122 may learn when the color process finishes. In operation 928, the host 122 may issue a command to the display controller 128 instructing the display engine 228 to begin a display update.

The method 920 may provide several advantages. Notably, the host 122 need not issue a command to the display controller 128 instructing the color engine 226 to begin a color processing operation.

Figure 10:
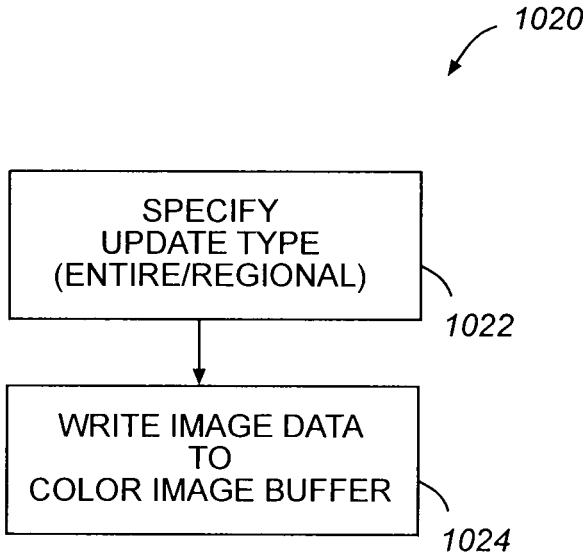
FIG. 10 is a simplified flow diagram illustrating a method for updating a display with color data using an exemplary display controller configured for automatically triggering a color engine when a data transfer operation finishes and automatically triggering a display engine when a color processing operation finishes.

FIG. 10 is a simplified flow diagram illustrating a method 1020 that may be performed by the host 122 to update the display matrix 126 with pixel data, according to one embodiment. The method 1020 may be used with an exemplary display controller configured so that operation of the color engine 226 may be automatically invoked when a transfer of image data is completed, and operation of the display engine 228 is automatically invoked when the color engine 226 completes its operations. In operation 1022, the host 122 writes one or more commands to the display controller 128 specifying the region of the display matrix to be updated. In operation 1024, the host 122 stores color pixel data in the color image buffer 620. In one alternative, the host 122 may store gray-scale pixel data in the processed image buffer 520 in operation 1024. In alternative embodiments, the streaming source 131 stores color pixel data in the color image buffer 620 or gray-scale pixel data in the processed image buffer 520. In one embodiment, the operation 1024 may include the host 122 writing a command to the display controller 128 indicating that the storing of image data has finished. In an alternative embodiment, the streaming source 131 provides a signal indicating that the storing of image data has finished, e.g., VSYNC. When the storing of image data has finished, the display update controller 230 may issue a command instructing the color engine 226 to begin processing the image data stored in the color image buffer 620. Alternatively, when the storing of gray-scale image data has finished, the display update controller 230 may issue a command instructing the display engine 228 to begin a display update operation. Moreover, when the processing of color image data by the color engine 226 color finishes, the display update controller 230 may issue a command instructing the display engine 228 to begin a display update operation.

The method 1020 may provide several advantages. The host 122 need not issue a command to the display controller 128 instructing the color engine 226 to begin a color processing operation. Further, the host 122 need not repeatedly poll the color process "busy" bit. In addition, the host 122 need not issue a command to the display controller 128 instructing the display engine 228 to begin a display update.

In one embodiment, the display engine 228 may include a collision detector 232. A collision may occur when the display engine 228 receives a first command to perform a display update for a first region of the display matrix 126 and a second command to perform a display update for a second region is received subsequent to the first command and before the first update finishes. In particular, a collision occurs when the first and second regions spatially overlap, i.e., one or more display pixels are located in both the first and second regions. In this context, one of the first and second regions may be the entire display matrix 126. When the display engine 228 performs a display update operation, it first performs a pixel synthesis operation and then a display output operation. As described above, the pixel synthesis operation modifies synthesized pixels stored in an update buffer, e.g., 528, 636, and the display output operation fetches synthesized pixels from the update buffer. A synthesized pixel may be repeatedly fetched in each drive frame period of a waveform period. A collision occurs when a pixel synthesis operation attempts to modify a synthesized pixel that may be fetched by as part of an active display output operation.

In one embodiment, the collision detector 232 modifies an active pixel synthesis operation when a collision is detected. In a pixel synthesis operation, the pixel processor 236 may read a data pixel stored in a processed image buffer, e.g., 520, 628, and a corresponding synthesized pixel stored in an update buffer, e.g., 528, 636. A fetched synthesized pixel may include an identifier of an assigned update pipe. The pixel processor 236 may inspect each synthesized pixel to determine if the assigned update pipe is currently active. If the assigned update pipe is active, the collision detector 232 may determine that a collision is detected and set an update pipe "busy" bit. When a collision is detected, the collision detector collision 232 may modify the pixel synthesis operation, and the display update controller 230 may begin monitoring the "busy" bit. The collision detector collision 232 may modify the pixel synthesis operation by causing the pixel for which a collision is detected to be skipped over, i.e., a synthesized pixel corresponding with the current pixel is not generated and stored in an update buffer. When the display output operation using the assigned update pipe finishes, the update controller 230 may reset the update pipe "busy" bit. Additionally, upon detecting that the display output operation has finished, the display update controller 230 may issue a command to start a new pixel synthesis operation.

Figure 11:
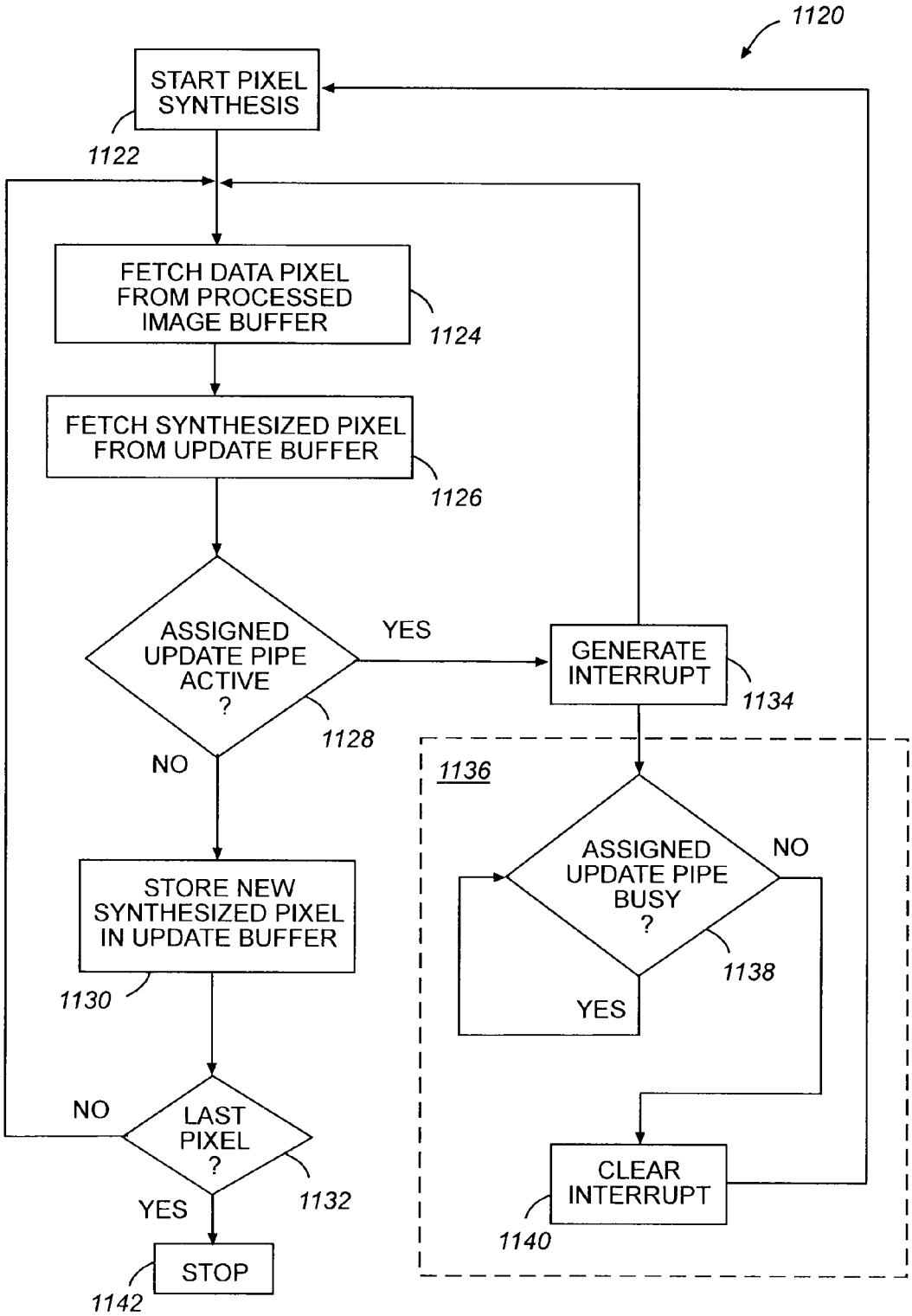
FIG. 11 is a simplified flow diagram illustrating a collision-handling method according to one embodiment.

FIG. 11 is a simplified flow diagram illustrating a collision-handling method 1120 that may be performed by the display controller 128, according to one embodiment. In an operation 1122, a pixel synthesis operation starts. The method 1120 may be performed one pixel at a time, however, this is not critical. The pixel processor 236 may fetch a data pixel from the processed image buffer, e.g., one of buffers 520, 628 (operation 1124), and a synthesized pixel from the update buffer, e.g., one of buffers 528, 636 (operation 1126). In operation 1128, the collision detector 232 may inspect the fetched synthesized pixel to determine which display pipe the display pixel is assigned to, and to determine if the assigned display pipe is currently active. If the assigned display pipe is not active, the pixel processor 236 may generate a new synthesized pixel and store it in the update buffer (operation 1130). A check may then be made to determine whether the display pixel location for new synthesized pixel is the last pixel location in the region to be updated (operation 1132). If the display pixel location is not the last pixel in the display update region, the method 1120 returns to operation 1124 where a next data pixel is fetched. On the other hand, if the display pixel location is the last pixel in the display update region, the method 1120 terminates (operation 1142).

If it is determined in operation 1128 that the assigned display update pipe is currently active, a collision bit may be set (operation 1134). In one embodiment, an interrupt may be generated in operation 1134. Setting the collision bit or generating an interrupt indicates that a collision has been detected at the current display pixel location. The pixel location where the collision is detected is not updated, i.e., the current display pixel location is omitted from the display update operation. After the current display pixel location is skipped, the method 1120 transitions to operation 1124, where the data pixel for the next display location is fetched. In addition, a process 1136 may be started. The process 1136 may operate in parallel with the method 1120 and may be performed by the display update controller 230. The process 1136 may include operation 1138 in which the activity state of the assigned display update pipe is monitored. When operation 1138 detects that the assigned display update pipe is no longer active, i.e., it has finished a display output operation, the collision bit or interrupt bit or flag may be cleared (operation 1140). After operation 1140, a new display update operation may be automatically triggered, i.e., the flow shown in FIG. 11 transitions from operation 1140 to operation 1122. In one embodiment, the display update operation that is triggered updates the entire display matrix 126. In an alternative embodiment, the display update operation that is triggered is a regional update that updates only the portion of the display matrix 126 having display pixel location collisions. The display update operation that is triggered may update only those display pixels having new pixel data (partial update), or may update all display pixels regardless of whether they have new pixel data (full update).

In one embodiment, the host-memory interface 222 may perform an operation that compares two successively received frames from an input source, such as the host 122 or the streaming source 131, to determine whether the second frame is different than the first frame. The second frame should correspond with the same set of display pixels as the first frame. For instance, the first and second frames may include data pixels for the entire display matrix 126, or for the same region of the display matrix. In addition, the second frame may be a frame received subsequent to the first frame. For example, the "second" frame may be the next sequential frame received following receipt of the first frame. Alternatively, the second frame may be third or other subsequent frame. The host-memory interface unit 222 may include a cyclic redundancy check unit (CRC) 240. In one embodiment, the CRC unit 240 calculates a checksum for a first frame of image data. The CRC unit 240 may store the calculated checksum for the first frame. The checksum may be computed using any method known in the art. For example, the checksum may be computed using any desired generator polynomial and modulo-2 arithmetic. After calculating a checksum for the first frame of image data, the CRC unit 240 calculates a checksum for a second frame of image data. The CRC unit 240 may compare the checksums of the first and second frames. If the checksums are equal, the first and second frames may be deemed equivalent. The CRC unit 240 may employ a 32-bit polynomial and algorithm described in the IEEE CRC-32 standard. In alternative embodiments, the CRC unit 240 may employ any other suitable known algorithm or polynomial. If the checksums of the first and second frames are equal, a method for automatically triggering an operation when a data transfer ends may be modified so that the operation is not automatically triggered. In one embodiment, the display controller 128 is configured to automatically invoke the color engine 226 when a data transfer finishes, however, if first and second frames are deemed to be equivalent, the color engine 226 is not automatically invoked. In another embodiment, the display controller 128 may be configured to automatically invoke the color engine 226 when a data transfer finishes and to invoke the display engine 228 when the color engine 226 finishes processing, however, if first and second frames are deemed to be equivalent, neither the color engine 226 nor the display engine 228 are automatically invoked.

In one embodiment, the host-memory interface 222 may include a buffer control unit 242. The processed image buffer 520 or the color image buffer 620 of the memory 130 may be configured to provide for double or triple buffering of transmitted image data. The host-memory interface 222 may determine when a transmission of new image data is to be started. Upon determining that a new image data transmission is to be started, the buffer control unit 242 may obtain a signal from the display update controller 230 or other source to determine if a pixel synthesis operation is in progress or active. If a pixel synthesis operation is active, the buffer control unit 242 may provide the memory controller 218 with a signal to store the new image data in a different buffer than the buffer currently being read in the active pixel synthesis operation. For example, if the active pixel synthesis operation is reading from buffer 522 (or 622), the buffer control unit 242 may signal the memory controller 218 to store the new image data in buffer 524 (or 624).

In addition to determining if a pixel synthesis operation is active, the buffer control unit 242 may obtain a signal from the display update controller 230 or other source, e.g., the color engine 226, to determine if a color processing operation is in progress or active. If a color processing operation is active, the buffer control unit 242 may provide the memory controller 218 with a signal to store the new image data in a different buffer than the buffer currently being read by the color engine 226 in the color processing operation.

In one embodiment, some or all of the operations and methods described in this description may be performed by hardware, software, or by a combination of hardware and software.

In one embodiment, some or all of the operations and methods described in this description may be performed by executing instructions that are stored in or on a non-transitory computer-readable medium. The term "computer-readable medium" may include, but is not limited to, non-volatile memories, such as EPROMs, EEPROMs, ROMs, floppy disks, hard disks, flash memory, and optical media such as CD-ROMs and DVDs. The instructions may be executed by any suitable apparatus, e.g., the host 122 or the display controller 128. When the instructions are executed, the apparatus performs physical machine operations.

In this description, references may be made to "one embodiment" or "an embodiment." These references mean that a particular feature, structure, or characteristic described in connection with the embodiment is included in at least one embodiment of the claimed inventions. Thus, the phrases "in one embodiment" or "an embodiment" in various places are not necessarily all referring to the same embodiment. Furthermore, particular features, structures, or characteristics may be combined in one or more embodiments.

Although embodiments have been described in some detail for purposes of clarity of understanding, it will be apparent that certain changes and modifications may be practiced within the scope of the appended claims. Accordingly, the described embodiments are to be considered as illustrative and not restrictive, and the claimed inventions are not to be limited to the details given herein, but may be modified within the scope and equivalents of the appended claims. Further, the terms and expressions which have been employed in the foregoing specification are used as terms of description and not of limitation, and there is no intention in the use of such terms and expressions to exclude equivalents of the features shown and described or portions thereof, it being recognized that the scope of the inventions are defined and limited only by the claims which follow.

The invention claimed is:

1. A method, comprising:

receiving a transmission of image data by an image data receiver;

initiating a color processing operation on the image data, without an external command to initiate the color processing operation, the image data receiver initiating the color processing operation in response to completion of the transmission of image data when the image data receiver is configured to automatically initiate the color processing operation in response to completion of the transmission of image data;

updating display pixels of a display matrix of an electro-optic display device;

initiating a display update operation, the image data receiver initiating the display update operation in response to completion of the color processing operation;

fetching a data pixel corresponding with a particular display pixel from a first buffer;

fetching a first synthesized pixel corresponding with the particular display pixel from a second buffer;

determining if a waveform for updating the display state of the particular display pixel has finished; and if the waveform for updating the display state of the particular display pixel has not finished, omitting the particular display pixel from the display update operation.

2. The method of claim 1, wherein the display device is an electrophoretic display device.

3. The method of claim 1, further comprising:

subsequent to initiating the omission of the particular display pixel from the display update operation, determining that the waveform for updating the display state of the particular display pixel has finished; and initiating a second display update operation in response to determining that the waveform for updating the display state of the particular display pixel has finished.

4. The method of claim 3, wherein the display device is an electrophoretic display device.

5. The method of claim 4, wherein the receiving a transmission of image data by an image data receiver includes determining a first checksum for the image data, further comprising:

receiving a transmission of second image data by the image data receiver, the receiving of the transmission of second image data by the image data receiver including determining a second checksum for the second image data; and disabling an initiation of the color processing operation on the second image data in response to completion of the transmission of second image data if the first and second checksums are equal.

6. A non-transitory display controller, comprising:

an interface to receive a transmission of image data;

a memory that stores the received image data;

a color engine;

a display update controller to cause the color engine to initiate a color processing operation on the image data, without an external command to initiate the color processing operation, in response to completion of the transmission of image data when the display controller is configured to automatically initiate the color processing operation in response to completion of the transmission of image data;

a display engine to perform a display update operation, the display update operation including updating display pixels of a display matrix of an electro-optic display device; and a collision detector to determine whether a waveform for updating a display state of a particular display pixel has finished, wherein the display update controller causes the particular display pixel to be omitted from a display update operation if the waveform for updating the display state of the particular display pixel has not finished;

wherein the display update controller causes the display engine to initiate a display update operation in response to completion of the color processing operation.

7. The display controller of claim 6, wherein the display device is an electrophoretic display device.

8. The display controller of claim 6, wherein the display update controller causes a second display update operation to be initiated in response to a determination by the collision detector that the waveform for updating the display state of the particular display pixel has finished, the determination by the collision detector that the waveform for updating the display state of the particular display pixel has finished being made subsequent to the causing of the particular display pixel to be omitted from the display update operation.

9. The display controller of claim 8, wherein the display device is an electrophoretic display device.

10. The display controller of claim 6, further comprising a unit to determine a first checksum for the image data and a second checksum for second image data, wherein the display update controller does not cause the color engine to initiate a color processing operation on the second image data in response to completion of the transmission of second image data when the display controller is configured to automatically initiate the color processing operation in response to completion of the transmission of image data if the first and second checksums are equal.

11. A non-transitory computer-readable medium storing two or more machine readable instructions which when executed cause an apparatus to perform operations comprising:

receiving a transmission of image data by an image data receiver;

initiating a color processing operation on the image data, without an external command to initiate the color processing operation, the image data receiver initiating the color processing operation in response to completion of the transmission of image data when the image data receiver is configured to automatically initiate the color processing operation in response to completion of the transmission of image data;

updating display pixels of a display matrix of an electro-optic display device;

initiating a display update operation, the image data receiver initiating the display update operation in response to completion of the color processing operation;

fetching a data pixel corresponding with a particular display pixel from a first buffer;

fetching a first synthesized pixel corresponding with the particular display pixel from a second buffer;

determining if a waveform for updating the display state of the particular display pixel has finished; and if the waveform for updating the display state of particular display pixel has not finished, omitting the particular display pixel from the display update operation.

12. The computer-readable medium of claim 11, further comprising:

subsequent to initiating the omission of the particular display pixel from the display update operation, determining that the waveform for updating the display state of the particular display pixel has finished; and initiating a second display update operation in response to determining that the waveform for updating the display state of the particular display has finished.

* * * * *